United States Patent [19]

Eian et al.

[11] Patent Number: 4,681,801

[45] Date of Patent: Jul. 21, 1987

[54] DURABLE MELT-BLOWN FIBROUS SHEET MATERIAL

[75] Inventors: Gilbert Eian, Mahtomedi; Paul G. Cheney, Woodbury, both of Minn.

[73] Assignee: Minnesota Mining and Manufacturing Company, St. Paul, Minn.

[21] Appl. No.: 899,522

[22] Filed: Aug. 22, 1986

[51] Int. Cl.[4] ..... B32B 5/16

[52] U.S. Cl. ..... 428/283; 428/284; 428/286; 428/288; 428/296; 428/297; 428/298; 428/299; 428/300; 428/373; 428/408; 428/903; 428/913

[58] Field of Search ..... 428/288, 296, 300, 297, 428/298, 244, 408, 903, 373, 283, 284, 286, 299, 913

[56] References Cited

U.S. PATENT DOCUMENTS

| | | | |
|---|---|---|---|
| 2,543,101 | 2/1951 | Francis | 154/101 |
| 2,984,584 | 5/1961 | Glarum et al. | 117/76 |
| 3,257,259 | 6/1966 | Law | 161/55 |
| 3,324,609 | 6/1967 | Stein et al. | 51/400 |
| 3,476,636 | 12/1969 | Crosby | 161/67 |
| 3,586,596 | 6/1971 | Ainsworth et al. | 161/87 |
| 3,595,731 | 7/1971 | Davies et al. | 161/150 |
| 3,769,144 | 10/1973 | Economy et al. | 161/50 |
| 3,783,085 | 1/1974 | Pearson et al. | 161/87 |
| 3,971,373 | 7/1976 | Braun | 428/328 |
| 4,021,593 | 5/1977 | Smith | 428/299 |
| 4,046,939 | 9/1977 | Hart | 428/311 |
| 4,118,531 | 10/1978 | Hauser | 428/297 |
| 4,146,663 | 3/1979 | Ikeda et al. | 428/96 |
| 4,170,676 | 10/1979 | Thomas | 428/113 |
| 4,196,245 | 4/1980 | Hitson et al. | 428/198 |
| 4,217,386 | 8/1980 | Arons et al. | 428/198 |
| 4,250,172 | 2/1981 | Mutzenberg et al. | 428/234 |
| 4,370,289 | 1/1983 | Sorenson | 428/903 |
| 4,429,001 | 1/1984 | Holpin et al. | 428/903 |
| 4,433,024 | 2/1984 | Eian | 428/233 |
| 4,436,780 | 3/1984 | Hotchkess et al. | 428/903 |
| 4,472,541 | 9/1984 | Sorenson et al. | 428/903 |
| 4,483,976 | 11/1984 | Yamamoto et al. | 528/295 |
| 4,495,030 | 1/1985 | Giglia | 428/903 |
| 4,495,238 | 1/1985 | Adiletta | 428/903 |
| 4,504,539 | 3/1985 | Petracek et al. | 428/195 |
| 4,539,982 | 9/1985 | Bailly | 128/156 |
| 4,548,856 | 10/1985 | Ali Khan et al. | 428/171 |
| 4,551,378 | 11/1985 | Carey, Jr. | 428/198 |
| 4,552,603 | 11/1985 | Harris, Jr. et al. | 156/167 |
| 4,555,811 | 12/1985 | Shimalla | 428/903 |
| 4,564,552 | 1/1986 | Adiletta | 428/903 |
| 4,588,635 | 5/1986 | Donovan | 428/299 |
| 4,602,922 | 7/1986 | Calasso et al. | 428/903 |
| 4,604,313 | 8/1956 | McFarland et al. | 428/300 |
| 4,618,524 | 10/1986 | Groitzsch et al. | 428/903 |

OTHER PUBLICATIONS

Kirk-Othmer, *Encyclopedia of Chemical Technology*, (3rd ed.), vol. 16, pp. 72-124, entitled "Non-Woven Textile Fabrics".

*Primary Examiner*—James J. Bell
*Attorney, Agent, or Firm*—Donald M. Sell; James A. Smith; Roger R. Tamte

[57] ABSTRACT

A durable fibrous sheet material comprised of a melt-blown fiber web having a plurality of reinforcing fibers extending therethrough is provided. The reinforcing fibers are needled through the web of melt-blown fibers and are then bonded to fibers on the opposing faces of the layer of melt-blown fibers to hold the reinforcing fibers in position. Solid particles can be dispersed in the layer of melt-blown fibers. Such particles are preferably vapor-sorptive particles, e.g., activated carbon, so that the sheet material will sorb vapors passing therethrough. The sheet material is particularly useful as a component of a chemical protective garment.

35 Claims, No Drawings

DURABLE MELT-BLOWN FIBROUS SHEET MATERIAL

FIELD OF THE INVENTION

This invention relates to non-woven fabrics or sheet materials and further relates to garments made from such fabrics.

BACKGROUND OF THE INVENTION

U.S. Pat. No. 4,433,024 (Eian) advanced the art of vapor-sorptive garments by providing a new vapor-sorptive, fibrous sheet material or fabric that achieves desired levels of toxic vapor sorption and yet exposes the wearer of a garment made with the sheet material to low heat and moisture stress. It has been found, however, under testing that imposes mechanical stress on the fabric, that greater durability would be desirable so as to maintain sorption for longer periods of time in the face of such mechanical stress. The sheet material is comprised of a fibrous web of melt-blown organic polymeric fibers having vapor-sorptive particles uniformly dispersed therein, and under mechanical stress the particles can migrate away from their original location thereby reducing vapor sorption in that region. In particular, uniforms made from the fabric showed dislocation of particles from high stress areas corresponding to the elbows and knees of the uniforms leaving the wearers susceptible to attack by toxic vapors at those points in the uniforms.

SUMMARY OF THE INVENTION

This invention provides a new melt-blown fibrous sheet material having improved durability under mechanical stress such that, for example, it will more durably hold particulate material such as vapor-sorptive particles and thereby achieve longer-lived vapor-sorptive garments. Briefly summarizing, this new sheet material comprises:

(a) a coherent layer of melt-blown organic polymeric fibers, and (b) a plurality of organic polymeric reinforcing fibers extending transversely through the layer of melt-blown fibers and being held in that position by bonding to fibers on the opposing faces of the layer of melt-blown fibers.

Reinforcing fibers incorporated into the web in this manner have been found to greatly increase the integrity and durability of the web, which is particularly useful to provide a more lasting holding of particles uniformly dispersed therein in their original location while still leaving the particles free to sorb vapor. At the same time, the web continues to impose only low heat and moisture stress.

DETAILED DESCRIPTION

The fibrous web of this invention can be prepared by needling reinforcing fibers through a preformed layer of melt-blown organic polymeric fibers and thereafter bonding the reinforcing fibers, e.g., by heating the web to temperatures at which the reinforcing fibers soften and become thermally bonded, so that the needled reinforcing fibers extending through the layer are bonded to fibers on each side of the preformed layer.

In addition to the melt-blown fibers, the preformed melt-blown fiber layer can also contain other fibers or particles. Examples of suitable fibers are staple fibers, e.g., synthetic fibers such as polyethylene terephthalate or natural fibers such as cotton or wool. Functional fibers such as heat-resistant fibers, e.g., polyimides, fiberglass or ceramics, can also be included, and vapor-sorptive carbon fibers are especially useful when incorporated into webs intended for vapor-sorptive applications.

The layer of melt-blown fibers is preferably prepared by techniques as generally described in Wente, Van A., "Superfine Thermoplastic Fibers," in Industrial Engineering Chemistry, Vol. 48, pages 1342 et seq (1956), and such layers with any other included fibers or particles are preferably prepared as disclosed in U.S. Pat. Nos. 3,971,373 (Braun), 4,433,024 (Eian), or 4,118,531 (Hauser); the disclosures of these prior art references are incorporated herein by reference. The melt-blown fibers are preferably microfibers, averaging less than about 10 micrometers in diameter, e.g., since such fibers offer more points of contact with the particles per unit volume of fiber. Very small fibers, averaging less than 5 or even 1 micrometer in diameter may be used, especially with vapor-sorbtive particles of very small size as discussed below.

Blown fibrous webs are characterized by an extreme entanglement of the fibers, which provides coherency and strength to a web and also adapts the web to contain and retain particulate matter. The aspect ratio (ratio of length to diameter) of blown fibers approaches infinity, though the fibers have been reported to be discontinuous. The fibers are long and entangled sufficiently that it is generally impossible to remove one complete fiber from the mass of fibers or to trace one fiber from beginning to end.

The invention is particularly useful to support any kind of solid particle that may be dispersed in an air stream ("solid" particle, as used herein, refers to particles in which at least an exterior shell is solid, as distinguished from liquid or gaseous). A wide variety of particles have utility in a three-dimensional arrangement in which they can interact with (for example, chemically or physically react with, or physically contact and modify or be modified by) a medium to which the particles are exposed. More than one kind of particle is used in some sheet products of the invention, either in mixture or in different layers. Air-purifying devices such as respirators in which the particles are intended for filtering or purifying purposes constitute a utility for sheet products of the invention. Typical particles for use in filtering or purifying devices include activated carbon, alumina, sodium bicarbonate, and silver particles which remove a component from a fluid by adsorption, chemical reaction or amalgamation; or such particulate catalytic agents as hopcalite, which catalyze the conversion of a hazardous gas to a harmless form, and thus remove the hazardous component. In other embodiments of the invention, the particles deliver rather than remove an ingredient with respect to the medium to which the particles are exposed.

The present invention is especially useful with sorptive particles, particularly vapor-sorptive particles. As used herein, sorptive particles are particles having sufficient surface area to sorb, at least temporarily, fluids which may be passed through the web. In certain embodiments, the particles sorb and bind the fluid while in other embodiments, the particles sorb the fluid only temporarily, i.e., long enough to effect a chemical change in the fluid. Vapor-sorptive particles perform such a function where the fluid is a vapor. Examples of suitable vapor-sorptive particles include alumina, hopcalite and porous polymeric sorbents. The preferred vapor-sorptive particles are activated carbon particles. A chemical reagent, e.g., potassium carbonate, or a catalytic agent, including enzymatic agents, may be included with the vapor-sorptive particles to chemically change or degrade sorbed vapors.

In preferred products of the invention, solid particles comprise at least about 20 volume percent of the solid content of the fibrous web, more preferably at least about 50 volume percent, and they are present at a density of at least about 50 g/m$^2$ of the area of the fibrous web.

As also taught in the previously mentioned U.S. Pat. No. 4,433,024, the layer of melt-blown fibers is desirably compacted to a thickness less than 2 millimeters and more desirably less than 1 millimeter to reduce heat stress on a person wearing a garment of the sheet material. In the completed sheet material, the insulation value contributed by the fibrous web of this invention is generally less than 0.4 clo, and preferably less than 0.2 clo as measured by the guarded-plate test of ASTM-1518; preferably the insulation value of the complete sheet material including porous supporting fabrics attached to a fibrous web of this invention is also less than those values.

The reinforcing fibers are bonded after they are needled through the layer of melt-blown fibers, meaning that at least a portion of the exterior of the fibers will soften upon the application of heat, pressure, ultrasonic energy, solvent or the like and thereby wet and bond to fibers that it contacts. Such bonding should occur under conditions such as elevated temperature that do not result in softening the melt-blown fibers and destruction of the fibrous nature of the layer of melt-blown fibers. The reinforcing fiber should also comprise a non-bonding portion continuous through its length. This non-bonding portion retains its dimensional integrity during bonding and thus contributes a measure of structural rigidity to the web.

Bicomponent fibers are preferred as the reinforcing fiber, and preferably have a component that bonds at a temperature lower than the melt-blown fibers. Suitable bicomponent fibers include those disclosed in U.S. Pat. Nos. 4,483,976, 4,551,378, and 4,552,603, the disclosures of which are incorporated herein by reference. For example, bicomponent fibers of polyethylene (lower melting) and polypropylene (higher melting) have been very effective with webs of the invention in which the melt-blown fibers are polypropylene. The denier of the reinforcing fibers may vary and is preferably less than about 3. Particularly preferred reinforcing fibers have a heat-fusible elliptical sheath and a heat-infusible core extending along the length of the fibers. Side-by-side and concentric sheath/core varieties are also useful.

The reinforcing fibers can be carded, garneted, or air-laid into a web, e.g., on a liner that supports the web for handling, then assembled against the layer of melt-blown fibers, and then needled or needle-tacked into the layer of melt-blown fibers. Such a preformed web of reinforcing fibers is generally lightweight, sufficient only to provide a handleable web, in order to minimize the heat stress and stiffness of the completed fibrous web. Despite the low amount of reinforcing fibers, the resulting fibrous web is greatly strengthened into a sheet material that has greatly increased utility, e.g. in a particle-loaded vapor-sorptive garment. For example, tensile strengths of at least 250 gm/cm width have been obtained. Also, good coherent strength has been obtained, as indicated by peel strengths from a fabric to which the web has been adhered of 500 gm/5 cm width or more. In preferred embodiments, the reinforcing webs are of insufficient density to lower the air permeability of the complete fibrous web to levels below 1 ft$^3$/min/ft as measured by Test Method 5450 in Federal Test Method Standard 191A, but for some uses such permeability is not needed. The precise density of the reinforcing web can vary, but preferred reinforcing webs range from about 10 g/m$^2$ to about 50 g/m$^2$. For best results, reinforcing fibers are included on both sides of the layer of melt-blown fibers.

By needling, it is meant any operation that will cause the reinforcing fibers to pass through the layer and extend between the opposing faces of the layer. While water-jet needling can be used, mechanical needling is preferred. Such a needling apparatus typically includes a horizontal surface on which a web is laid or moves and a needle board which carries an array of downwardly depending needles. The needle board reciprocates the needles into, and out of, the web and reorients some of the fibers of the web, especially the reinforcing fibers, into planes transverse, or substantially so, to the planar surfaces of the web. The needles chosen can push fibers through the web from one direction, or e.g., by use of barbs on the needles, can both push fibers through the layer from the top and pull fibers from the bottom. Preferred embodiments of this invention are double-needled, i.e., a web of reinforcing fibers is needled from each of the opposing surfaces of the particle-loaded layer of melt-blown fibers. The density of the needling can vary, but we have obtained quite satisfactory results with densities less than 50 punches per square inch, e.g., 10–20 punches per square inch.

After needling, an assembly of bicomponent thermobondable reinforcing fibers and layer of melt-blown fibers can be moved through an oven and heated to a temperature higher than the fusion temperature of a fusible component of the bicomponent reinforcing fibers, whereupon the reinforcing fibers become bonded together. At least some portion of the reinforcing fibers extend completely through the layer of melt-blown fibers, and become bonded to fibers, e.g., other reinforcing fibers or melt-blown fibers, on each side of the layer. The bicomponent fibers generally tend to crimp, e.g., curl, during this thermobonding operation as a result of different shrinkage characteristics of the components of the bicomponent fiber. At least in part because of this crimping action, the whole assembly is drawn together in a more compacted durable sheet product. The crimping of the fibers may also serve to obstruct or close openings created by the needle-tacking operation, thereby retaining the vapor-sorptive properties of the web.

Some of the reinforcing fibers are not drawn fully through the layer of melt-blown fibers but may be bonded to the melt-blown fibers through softening of the bonding portion of the reinforcing fiber. However, as noted above, the temperatures used generally do not soften the melt-blown fibers, and the fibrous structure of the melt-blown fibers is retained intact except for the compacting of the structure that occurs through the action of the reinforcing fibers.

The finished fibrous web, i.e., the composite layer of melt-blown fibers and needled bonded reinforcing fibers, may serve as a stand-alone sheet material or fabric. The faces of the reinforced web are generally substantially planar; i.e., the needled reinforcing fibers do not appreciably extend from the surface of the web in a direction normal to the plane of the surface. In the stand-alone form, the reinforced web is also preferably free of any adhesive apart from the bonding portion of the reinforcing fibers because such adhesive could coat the solid particles and thereby reduce or eliminate their sorptive capability. However, at least for use in vapor-sorptive garments, it is preferred to attach a support fabric to the described composite fibrous web, generally on both sides of the web, to complete sheet material of the invention. The fabric is preferably adhered to the web with an adhesive applied in a discontinuous manner, e.g., by use of spray adhesives which apply scattered droplets, or by printing in a pattern, to preserve permeability. The adhesive should not penetrate throughout, or fill the layer of melt-blown fibers, so as to preserve the properties of that layer. The fabrics can also be sewn to the fibrous web or attached by ultrasonic welding.

A variety of support fabrics may be used. For use in garments, the support fabric on at least one face of the web should have a grab strength (as measured by Test Method Number 5100 in the Federal Test Method Standard Number 191A) of at least 100 kilograms per centimeter thickness, and preferably at least 500 kilograms per centimeter of thickness. The sheet material is typically used to form all or substantially all of a garment, i.e., wearing apparel that is used to cover a substantial part of the human body, including coats, jackets, trousers, hoods, casualty bags in which an injured or wounded person is placed, and the like. The sheet material is also useful in tents, filters and the like, especially those where the improved strength from reinforcement is advantageous.

EXAMPLES

A web of melt-blown polypropylene microfibers loaded with particles of activated carbon was prepared by the process described in U.S. Pat. No. 4,433,024. The microfibers and carbon particles ranged respectively between about 0.5 and 10 micrometers and between about 40 and 300 micrometers in diameter. The carbon had static carbon tetrachloride capacity of at least 60% and is available from Calgon under the designation RFMC. The fibers in the web weighed about 18 grams per square meter, and the complete, particle-loaded web weighed about 145 grams per square meter.

An air-laid randomized reinforcing web of polyethylene/polypropylene eccentric sheath/core fibers (available as Chisso TM ES fibers from Chisso Corporation, Osaka, Japan) having a denier of 1.5 and a length of 38 mm was formed by air-laying with a Rando-Webber TM unit available from Curlator Corporation, Rochester, N.Y. The weight of the air-laid web was about 12 g/m$^2$. The air-laid web was collected on a paper liner, which was discarded when the reinforcing web was laid down on the melt-blown fiber web.

To reinforce the melt-blown microfiber web, the reinforcing web was laid out onto the microfiber web and run through a needletacker available from James Hunter Machine Company. The needletacker had multiple rows of barbed tacking needles having a round shank and a triangular point (available from Singer Company under the designation 418 812 050 0). Each needle was spaced approximately 0.6 cm apart, the needles stroked at a frequency of 185 strokes per minute and the web moved past the needles at a rate of 64 yards per hour, which means the needle punch density was about 13 strokes per square inch. As the combined webs were run through the needletacker, the needles moved vertically in a direction normal to the face of the webs and pierced first the air-laid web and then the microfiber web. This action drove reinforcing fibers through the microfiber web to extend from the opposite face of the microfiber web. The needle-tacked web was then turned over and a second reinforcing web was needle-tacked as described above to the opposite face of the microfiber web. The double-tacked web was then passed horizontally through a convection oven having a vertical air stream which acted to lift or float the web while in the oven. The oven was maintained at about 150° C. and the dwell time was about 1 minute.

The resulting web was then tested for strength and carbon tetrachloride capacity. The dynamic carbon tetrachloride capacity was measured according to military standard MIL-C-43858 (GL), which was greater than the 1.8 gm/cm$^2$ called for in the standard. The tensile strength of the web was tested as follows. A sample was cut into strips of about 2.5 cm by about 30 cm and placed in an Instron TM tensile tester with a jaw gap of about 25 cm and a crosshead speed of about 30 cm/min. The web exhibited an average tensile strength in the cross web direction of about 470 g/cm and in the down web direction of about 500 g/cm. Comparable webs which have not been reinforced have a tensile strength in the down web direction of about 220 g/cm width or less.

A second mechanical test was also conducted to evaluate the coherent strength of the web and was accomplished by laminating a sample web to a support fabric and measuring the force required to peel the web away from the support fabric. The adhesive used to laminate the sample had a strength sufficient to ensure a coherent failure of the reinforced web under the conditions of the test. This test was performed on a web sample having a dimension of about 5 cm by about 15 cm. The web and support fabric along the 5 cm side were manually separated along the 15 cm length sufficient to place one of the separated web and fabric into the upper jaw of an Instron TM tensile tester and the other into the lower jaw. The jaw gap was set at about 2.5 cm and the crosshead speed at 30 cm/min. The web exhibited an average peel strength of about 900 g/5 cm width in the cross web direction and about 1000 g/5 cm width in the down web direction.

Other samples of the carbon-loaded microfiber web were laminated between support fabrics as follows. Two fabrics were spray-coated on one side with droplets of adhesive (3M Brand Spray Adhesive 77) in an amount of about 8 grams per square meter on each fabric. One of the fabrics, adapted to serve as the outer fabric in a garment, was a water repellent 50/50 nylon-cotton twill having a weight of 160 grams per square meter (available from Gilbraltar Industries and meeting the requirements of military specification MIL-C-43892). The other fabric, adapted to serve as the inner fabric or liner, was a nylon tricot knit fabric having a nominal weight of 64 grams per square meter (available from Engineered Fabrics Incorporated, Style 532; this fabric meets military specification MIL-C-43858 (GL)). After the sprayed adhesive had dried, the carbon-loaded microfiber web was assembled between the adhesive-coated sides of the two fabrics, and the assembly was passed through a nip roll heated to about 200°-220° F. The adhesive softened and penetrated into the large-surface edges of the melt-blown web, and upon cooling of the assembly, a laminate was formed. The laminate continued to exhibit a dynamic carbon tetrachloride capacity of 1.8 g/cm$^2$.

What is claimed is:

1. A durable melt-blown fibrous sheet material comprising:

(a) a coherent layer of melt-blown organic polymeric fibers, and (b) a plurality of organic polymeric reinforcing fibers extending transversely through the layer of melt-blown fibers and being held in that position by bonding to fibers on the opposing faces of the layer of melt-blown fibers.

2. A sheet material of claim 1 wherein said sheet material exhibits an insulation value of less than about 0.4 clo.

3. A sheet material of claim 1 in which the reinforcing fibers are bicomponent fibers comprising a heat-fusible component and another component that is infusible at the fusing temperature of the first component.

4. A sheet material of claim 3 in which the heat-fusible component fuses at a temperature of less than 150° C.

5. A sheet material of claim 1 in which the melt-blown fibers have diameters averaging less than 10 micrometers.

6. A sheet material of claim 1 in which the reinforcing fibers are needled into the layer of melt-blown fibers.

7. A sheet material of claim 6 in which reinforcing fibers are needled into the layer of melt-blown fibers from each side of the layer.

8. A sheet material of claim 7 wherein the web is heated to thermally bond the reinforcing fibers after the fibers are needled into the layer.

9. A sheet material of claim 1 wherein solid particles are uniformly dispersed in the layer of melt-blown fibers.

10. A sheet material of claim 9 wherein the solid particles are vapor-sorptive particles and comprise at least about 20 volume percent of the layer of melt-blown fibers.

11. A sheet material of claim 9 wherein the particles comprise activated carbon.

12. A sheet material of claim 9 wherein the particles comprise alumina.

13. A sheet material of claim 9 wherein the particles comprise porous polymeric sorbents.

14. A sheet material of claim 9 wherein the particles comprise hopcalite.

15. A sheet material of claim 9 wherein the particles comprise a chemical reagent or a catalytic agent.

16. A sheet material of claim 9 wherein the particles are dispersed in the web in an amount of at least 50 gm/m$^2$ of the web and in an amount that comprises at least about 50 volume percent of the web.

17. A sheet material of claim 1 having an air permeability of at least 1 ft$^3$/min/ft$^2$.

18. A sheet material of claim 1 wherein the plurality of reinforcing fibers comprises an air-laid web.

19. A sheet material of claim 1 wherein the reinforcing fibers have a denier less than about 3.

20. A sheet material of claim 1 wherein the reinforcing fibers are staple fibers having a length of from about 25 mm to about 50 mm.

21. A sheet material of claim 1 wherein the reinforcing fiber comprises a 1.5 denier bicomponent fiber comprising polyethylene and polypropylene components and having a staple length of about 38 mm.

22. A sheet material of claim 1 having a peel strength of at least 500 gm/5 cm width.

23. A sheet material of claim 1 having a tensile strength of at least 250 gm/cm width.

24. A sheet material of claim 1 having a dynamic carbon tetrachloride capacity of at least 1.8 gm/cm$^2$.

25. A garment having as one component a sheet material which comprises a permeable support fabric attached to at least one face of the sheet material of claim 1.

26. A garment of claim 25 wherein said sheet material has a thickness of less than about 2 millimeters.

27. A garment of claim 25 further comprising a second support fabric attached to an opposing face of said sheet material.

28. A sheet material comprising a fibrous web that exhibits an insulation value of less than about 0.4 clo and comprises:

(a) a coherent layer of melt-blown organic polymeric microfibers that average less than 10 micrometers in diameter, and (b) webs of organic polymeric bicomponent reinforcing fibers averaging less than about 3 denier disposed on opposite faces of the layer of melt-blown fibers and thermally bonded together at points of intersection by fusion of one component of the bicomponent fibers, at least some of the reinforcing fibers extending transversely through the layer of melt-blown fibers and being held in that position by thermal bonding to reinforcing fibers on the opposing faces of the layer of melt-blown fibers.

29. A sheet material of claim 28 in which the melt-blown fibers comprise polypropylene.

30. A sheet material of claim 28 in which the reinforcing fibers are bicomponent fibers comprising polyethylene and polypropylene.

31. A sheet material of claim 30 in which the melt-blown fibers comprise polypropylene.

32. A sheet material of claim 28 in which reinforcing fibers are needled into the layer of melt-blown fibers from each side of the layer.

33. A sheet material of claim 28 in which vapor-sorptive fibers are uniformly dispersed in the layer of melt-blown fibers.

34. A sheet material of claim 33 wherein said sheet material has a thickness of less than about 2 millimeters.

35. A garment having as one component a sheet material which comprises a permeable support fabric attached to the sheet material of claim 28.

* * * * *